US009937386B2

(12) United States Patent
Jennings

(10) Patent No.: US 9,937,386 B2
(45) Date of Patent: Apr. 10, 2018

(54) BALL COLLECTION DEVICE

(71) Applicant: James Douglas Jennings, Boca Raton, FL (US)

(72) Inventor: James Douglas Jennings, Boca Raton, FL (US)

( * ) Notice: Subject to any disclaimer, the term of this patent is extended or adjusted under 35 U.S.C. 154(b) by 0 days.

(21) Appl. No.: 15/236,452

(22) Filed: Aug. 14, 2016

(65) Prior Publication Data

US 2017/0043221 A1 Feb. 16, 2017

Related U.S. Application Data

(60) Provisional application No. 62/205,360, filed on Aug. 14, 2015.

(51) Int. Cl.

| | |
|---|---|
| ***A63B 47/02*** | (2006.01) |
| *A63B 102/02* | (2015.01) |
| *A63B 60/00* | (2015.01) |

(52) U.S. Cl.

CPC ..... *A63B 47/02* (2013.01); *A63B 2060/0085* (2015.10); *A63B 2102/02* (2015.10); *A63B 2210/50* (2013.01)

(58) Field of Classification Search

CPC .. A63B 47/02; A63B 2210/50; A63B 2102/02

USPC ..... 294/19.2, 179; 414/439, 440; 473/431, 473/460; 171/63; 56/328.1

See application file for complete search history.

(56) References Cited

U.S. PATENT DOCUMENTS

| | | | | | |
|---|---|---|---|---|---|
| 2,817,405 | A * | 12/1957 | Pearson | A63D 5/02 | 171/63 |
| 3,593,868 | A * | 7/1971 | Folz | A63B 47/021 | 414/440 |
| 3,604,532 | A * | 9/1971 | Moore | E01D 15/24 | 114/362 |
| 4,549,758 | A * | 10/1985 | Meshulam | A63B 47/02 | 294/19.2 |
| 4,602,401 | A * | 7/1986 | Holroyd | B05C 17/10 | 15/144.1 |
| 4,721,428 | A * | 1/1988 | Rohrer | A63B 47/021 | 414/439 |
| 5,147,100 | A * | 9/1992 | Frankel | A63B 47/021 | 294/19.2 |
| 8,075,030 | B2 | 12/2011 | Pearson et al. | | |
| 8,313,396 | B1 * | 11/2012 | Mailman | A63B 47/021 | 473/460 |
| 8,602,711 | B1 * | 12/2013 | Nash | A63B 47/021 | 294/19.2 |

(Continued)

*Primary Examiner* — Paul T Chin

(74) *Attorney, Agent, or Firm* — Nicholas R. Lewis, Esq.

(57) ABSTRACT

A ball collection device, including a handle; a first tube segment and a second tube segment coupled substantially perpendicularly to the handle; a multi-directional roller ball coupled to the first and second tube segments; a crossbar coupled to the handle adjacent and substantially parallel to the first and second tube segments; a first arm coupled to and extending substantially perpendicular from the first tube segment; a first wing extending from the first arm that is configured to deflect objects downward; a second arm coupled to and extending substantially perpendicular from the second tube segment; a second wing extending from the second arm that is configured to deflect objects downward; and at least one roller rotatably mounted on each of the first and second tube segments and the crossbar.

20 Claims, 15 Drawing Sheets

(56) References Cited

U.S. PATENT DOCUMENTS

| | | | | |
|---|---|---|---|---|
| 8,920,101 | B2 * | 12/2014 | Leyco | A63B 47/021 294/19.2 |
| 9,480,885 | B1 * | 11/2016 | Tarwater | A63B 47/021 |
| 9,764,202 | B2 * | 9/2017 | Chen | A63B 47/021 |
| 2006/0082171 | A1 * | 4/2006 | Olmstead | A63B 47/021 294/19.2 |

* cited by examiner

BALL COLLECTION DEVICE

CROSS-REFERENCE TO RELATED APPLICATION

This application is related to and claims priority to U.S. Provisional Patent Application Ser. No. 62/205,360, filed Aug. 14, 2015, entitled BALL COLLECTION DEVICE, the entirety of which is incorporated herein by reference.

STATEMENT REGARDING FEDERALLY SPONSORED RESEARCH OR DEVELOPMENT n/a

FIELD OF THE INVENTION

The invention relates to a ball collection device and, more particularly, to a push broom-style ball collector that has improved maneuverability.

BACKGROUND OF THE INVENTION

Push broom style ball collectors are known. For example, U.S. Pat. No. 8,075,030 to Robert Pearson et al. (the '030 patent), discloses a foldable device for retrieving golf, tennis or other balls. In the '030 patent, a strap or length of cord formed from nylon or another resilient material is secured to a side of the mesh material adjacent brace member and forms a loop or lifting handle. A pair of wheels or castors is secured to the undersides of the arm members and at the first ends.

U.S. Pat. No. 2,817,405 to W. C. Pearson discloses a bowl retriever having a generally trapezoidal shape. The sides of the trapezoidal frame extend forwardly at equal obtuse angles relative to a bearing member or rear side of the frame. The frame is supported by two caster wheels located at the forward ends of the frame sides, remote from the bearing member, and by two axially spaced elongate rollers that are mounted beneath, and extending longitudinally of, the bearing members on suitable journal brackets.

Similarly, U.K. Patent No. 539,348 to Atcherley discloses a wheeled collecting device having a handle, rubber covered rollers on its front face adapted to engage with the bowls so that the bowls will roll easily in front of the device, and which is supported by rubber tired castors or other wheels.

Additionally, certain ball collector products are available in the market, such as the Scorpion Ball Sweeper, the Green Rake by Range Servant, and the Dry Court Tennis Ball Sweeper by Tennisnuts™.

What is needed is a push broom-type ball collector that is easy to manipulate and rotate in any direction.

SUMMARY OF THE INVENTION

It is accordingly an object of the invention to provide a push broom-type ball collector that solves the disadvantages of ball collecting devices of the prior art. In particular, it is an object of the present invention to provide a ball collecting device that can be moved easily in any direction and is easy to manipulate and use. In one particular embodiment of the invention, a push broom-type ball collector is provided that utilizes a multi-directional center roller ball that permits the collector to be manipulated and rotated in any direction.

The present invention advantageously provides a ball collection device, including a handle; a multi-directional roller ball coupled to an end of the handle; a bottom tube coupled to the roller ball substantially perpendicular to the handle; a first arm coupled to and extending substantially perpendicular from the bottom tube; and a second arm coupled to and extending substantially perpendicular from the bottom tube. The bottom tube may include a first tube segment and a second tube segment, wherein the first and second tube segments enclose at least a portion of the roller ball. The ball collection device may include a ball shield covering at least a portion of the roller ball, wherein the ball shield may be configured to deflect external objects away from the roller ball. At least one of the first and second arms may include a wing extending at an angle therefrom and/or may include a crossbar coupled to the handle adjacent to the bottom tube. The crossbar may be substantially parallel to the bottom tube and/or may be substantially V-shaped. The ball collection device may include at least one roller coaxially and rotatably mounted on the crossbar and/or a curvilinear support bracket connecting the handle to at least one of the crossbar and bottom tube. The ball collection device may include at least one roller coaxially and rotatably mounted on the bottom tube and/or may include a first wheel coupled to the first arm and a second wheel coupled to the second arm. The handle of the ball collection device may be selectively adjustable.

A ball collection device is disclosed, including a handle; at least one crossbar coupled substantially perpendicular to the handle; a multi-directional roller ball coupled to the at least one crossbar; and a plurality of arms, wherein the at least one crossbar and the plurality of arms form a ball capture region. The at least one crossbar may include a bottom tube and a crossbar substantially parallel and vertically adjacent to the bottom tube. The bottom tube may include a first tube segment and a second tube segment, wherein the first and second tube segments enclose at least a portion of the roller ball. Each of the plurality of arms may include a wing extending at an angle therefrom configured to direct balls towards the ball capture region. The ball collection device may include a plurality of rollers rotatably coupled to the at least one crossbar. Each of the plurality of rollers may be concentrically mounted on the at least one crossbar.

A ball collection device is disclosed, including a handle; a first tube segment and a second tube segment coupled substantially perpendicularly to the handle; a multi-directional roller ball coupled to the first and second tube segments; a crossbar coupled to the handle adjacent and substantially parallel to the first and second tube segments; a first arm coupled to and extending substantially perpendicular from the first tube segment; a first wing extending from the first arm that is configured to deflect objects downward; a second arm coupled to and extending substantially perpendicular from the second tube segment; a second wing extending from the second arm that is configured to deflect objects downward; and at least one roller rotatably mounted on each of the first and second tube segments and the crossbar. The handle of the ball collection device may be selectively adjustable.

A ball collection device is provided, including a handle; a first tube segment and a second tube segment coupled substantially perpendicularly to the handle; a multi-directional roller ball coupled to the first and second tube segments; a crossbar coupled to the handle horizontally offset from the first and second tube segments; a first arm coupled to and extending substantially perpendicular from the first tube segment; a first wing extending from the first arm that is configured to deflect objects downward; a second arm coupled to and extending substantially perpendicular from the second tube segment; a second wing extending from the second arm that is configured to deflect objects downward; and a plurality of rollers rotatably coupled to the crossbar. The plurality of rollers may include a first plurality of rollers substantially aligned with each other and vertically adjacent to a second plurality of rollers substantially aligned with each other.

Although the invention is illustrated and described herein as embodied in a rolling ball collector, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
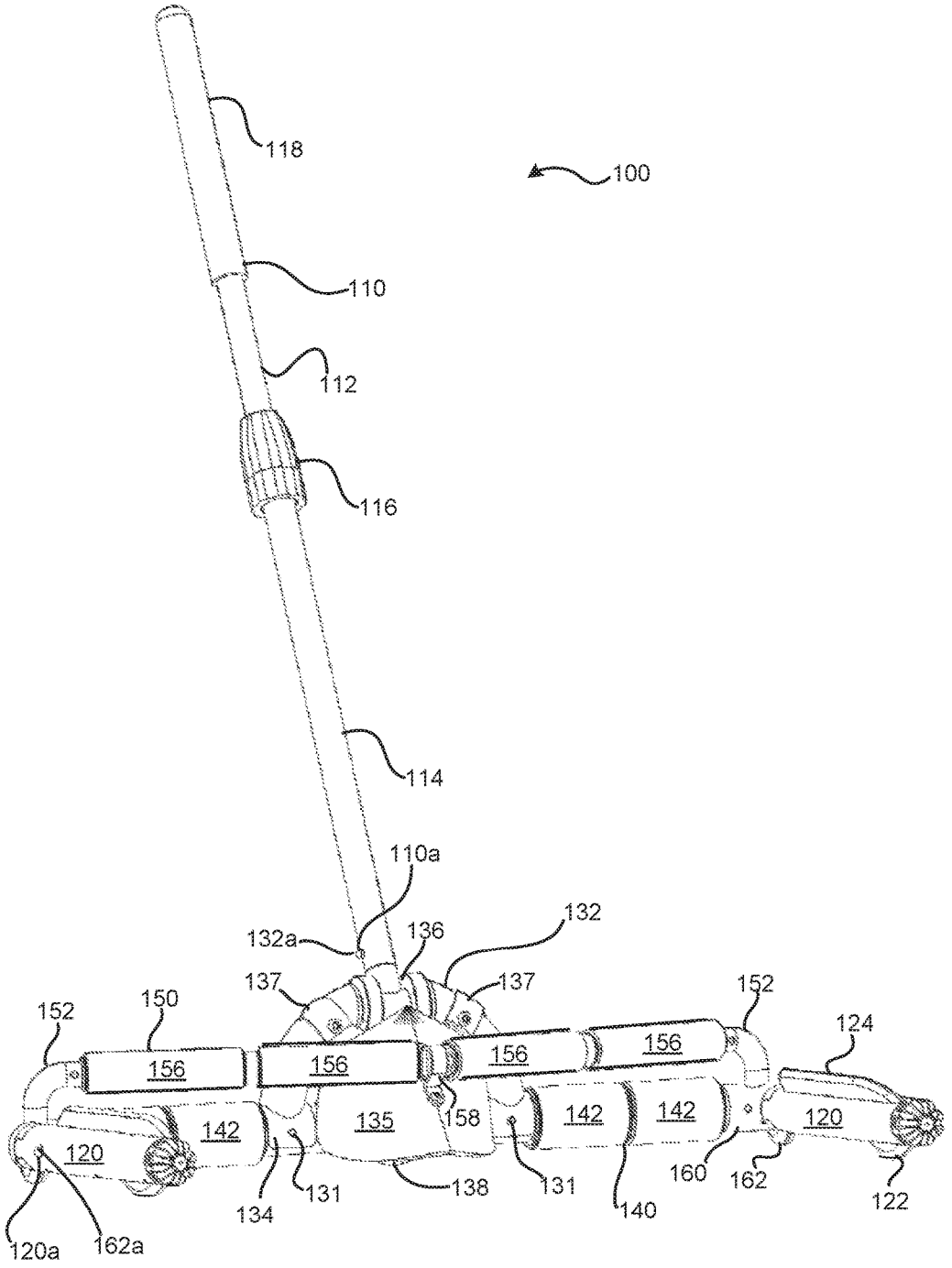
FIG. 1 is an isometric view of a ball collection device in accordance with one particular embodiment of the present invention.
Figure 2:
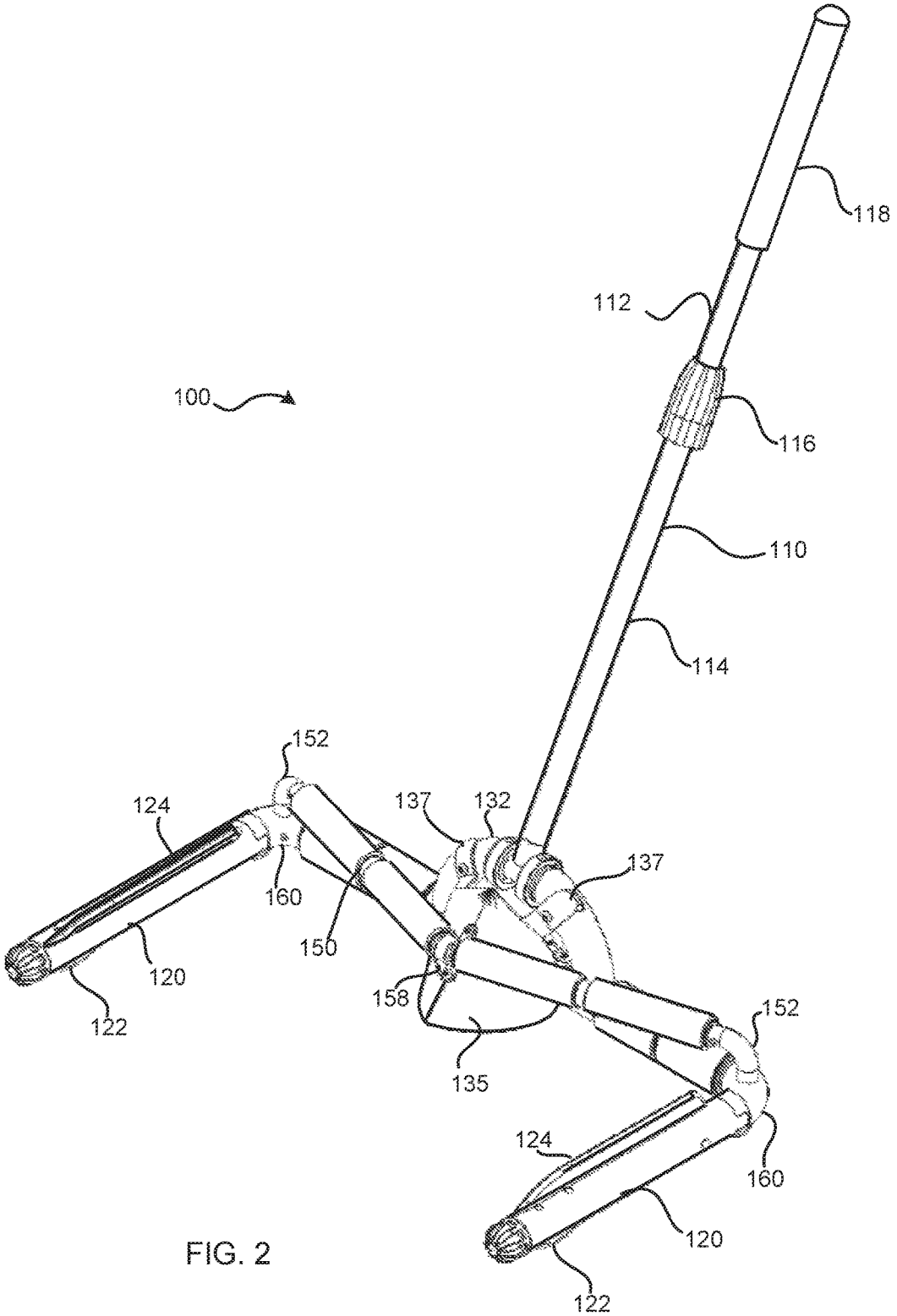
FIG. 2 is a perspective view of a ball collection device in accordance with one particular embodiment of the invention.
Figure 3:
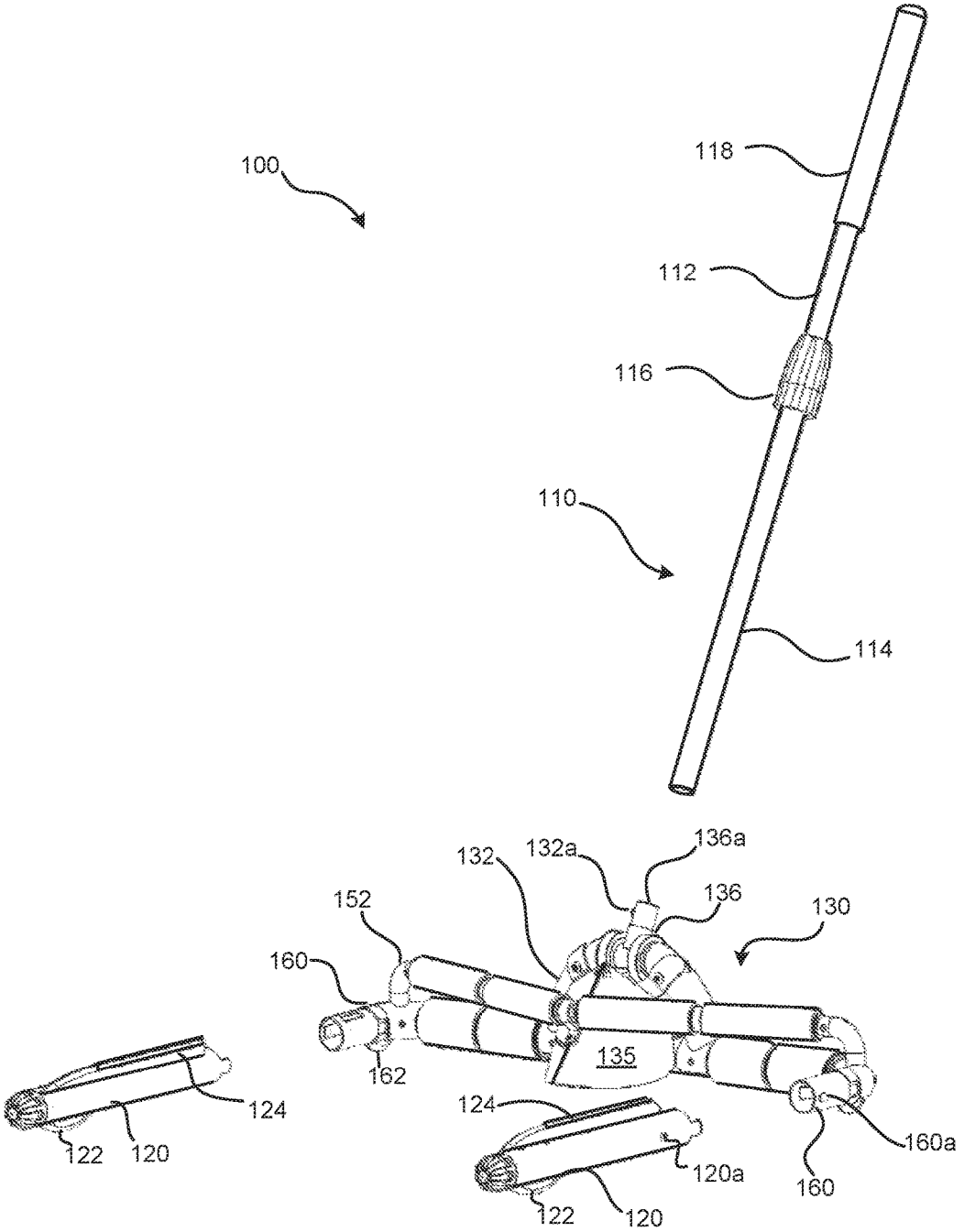
FIG. 3 is an exploded view of the ball collection device of FIG. 2.
Figure 4:
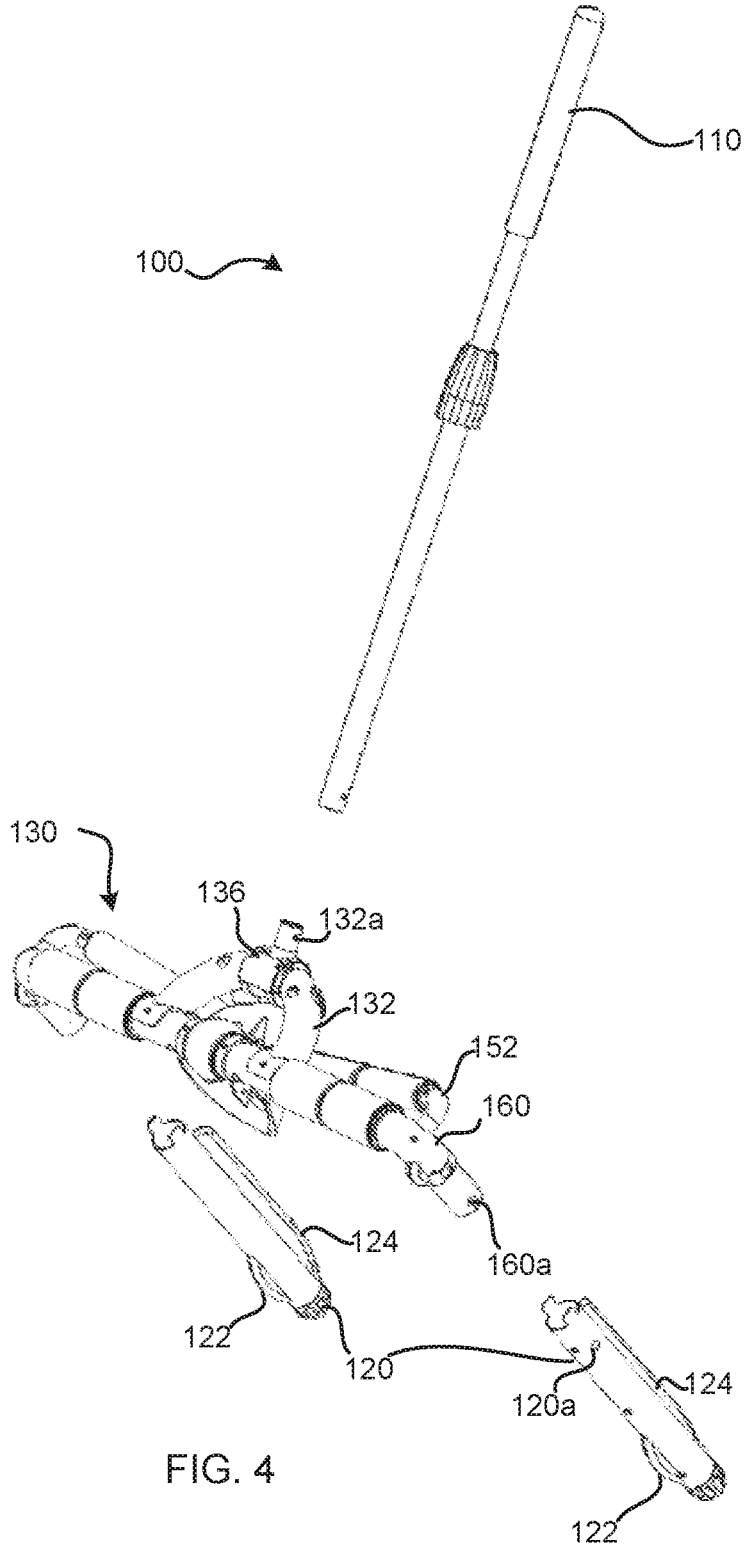
FIG. 4 is an exploded view, taken from the bottom, of the ball collection device of FIG. 2.

Referring now to FIGS. 1-6, there is shown one particular embodiment of a ball collection device 100. The ball collection device 100 is a push-broom style ball collector including a handle 110, arms 120, and a backplane 130. Each of the handle 110 and the arms 120 are connected to, and removable from, the backplane 130 via a fastening mechanism. In one particular embodiment of the invention illustrated in the figures, the fastening mechanism includes a spring pin and hole combination. The invention is not meant to be limited to this, however, as other ways of fixing the handle 110 and arms 120 to the backplane 130, such as, welding, screwing, pinning, etc., can be used to removably or permanently connect the handle 110 and/or arms 120 to the backplane 130 without departing from the scope of the present invention.

The Handle: As discussed above, the ball collection device 100 includes a handle or main handle assembly 110, with which it can be pushed and/or maneuvered. In one particular embodiment of the invention illustrated in the figures, the handle 110 is a telescoping handle made from two or more concentric pipe sections 112, 114, with a rotating locking member 116 that permits the length of the handle 110 to be selected and set at a preferred length. In the preferred embodiment illustrated, the handle 110 additionally includes a grip 118, for ease in grasping the handle and for comfort. The handle 110 may be coupled to one or more components described herein employing a variety of rotational, pivotal, or other movable joint mechanisms to allow the angle of the handle 110 to be freely moved and changed during use of the ball collection device 100.

The Backplane: The backplane 130 includes a bottom tube 140, which acts as the base component of the backplane 130, to which all of the other elements of the backplane 130 are connected. For example, a support bracket 132 is mounted to the bottom tube 140 via curved brackets 134 bolted to the bottom tube 140 using mechanical fasteners or bolts 131. This is not meant to be limiting, as the curved brackets 134 could be permanently fixed to the bottom tube through welding, gluing, pinning, etc., as desired. In one particular embodiment of the invention, the bottom tube 140 is formed from anodized aluminum tubing, although other materials may be used without departing from the spirit or scope of the present invention. Further, although referred to as a "tube," the cross sectional shape and construct of the bottom tube 140 is not limited to circular or hollow embodiments.

In the present preferred embodiment, the handle 110 connects to, and is removable from, the support bracket 132, via a fastening mechanism or fastener 115. In one particular embodiment, the pipe section 114 mates concentrically with a pipe section 136*a* (or, alternately, a socket, not shown) of the support bracket 132 and the fastener includes a spring pin 132*a* on a portion of the support bracket 132 that mates with a hole 110*a* through the shaft of pole 114, or vice-versa. A portion 136 of the support bracket 132 is provided at a particularly defined angle, so that the handle 110 connected thereto is at a non-perpendicular angle with respect to the ground. If desired, the angle of the portion 136 may be adjustable to permit the user to change the angle of the handle 110 relative to the ground.

Figure 5A:
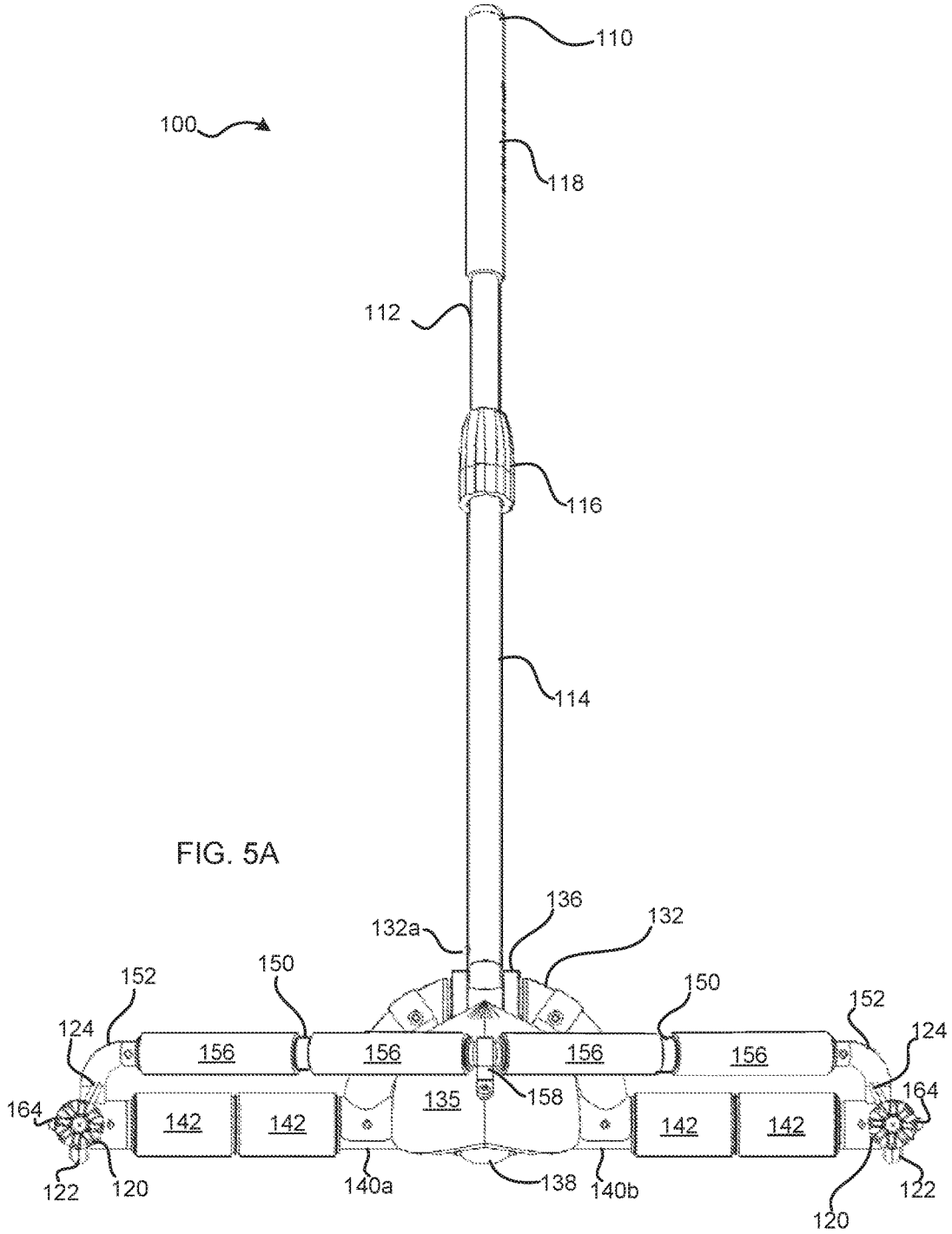
FIG. 5A is a front plan view of a ball collection device in accordance with one particular embodiment of the invention.
Figure 5B:
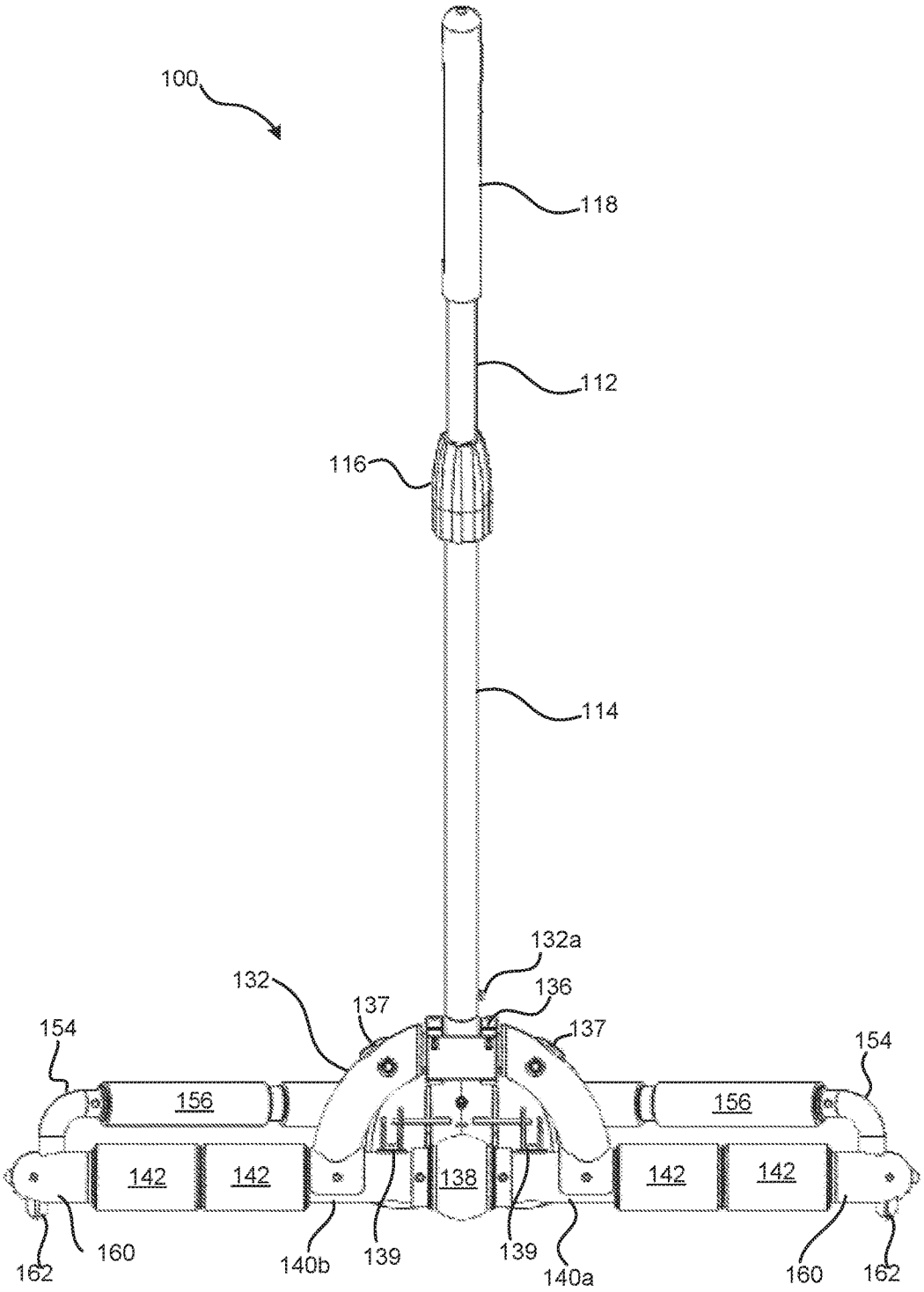
FIG. 5B is a rear plan view of a ball collection device in accordance with one particular embodiment of the invention.
Figure 5C:
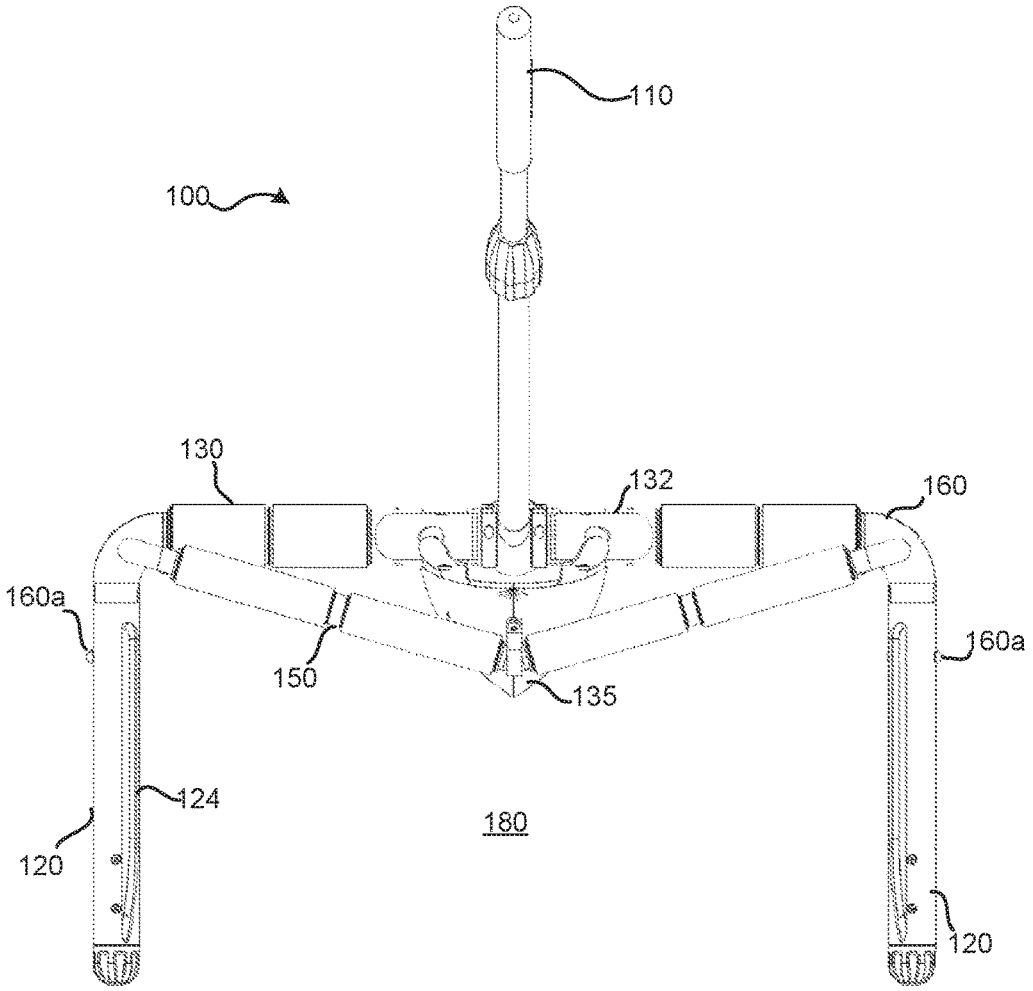
FIG. 5C is a top plan view of a ball collection device in accordance with one particular embodiment of the present invention.
Figure 5D:
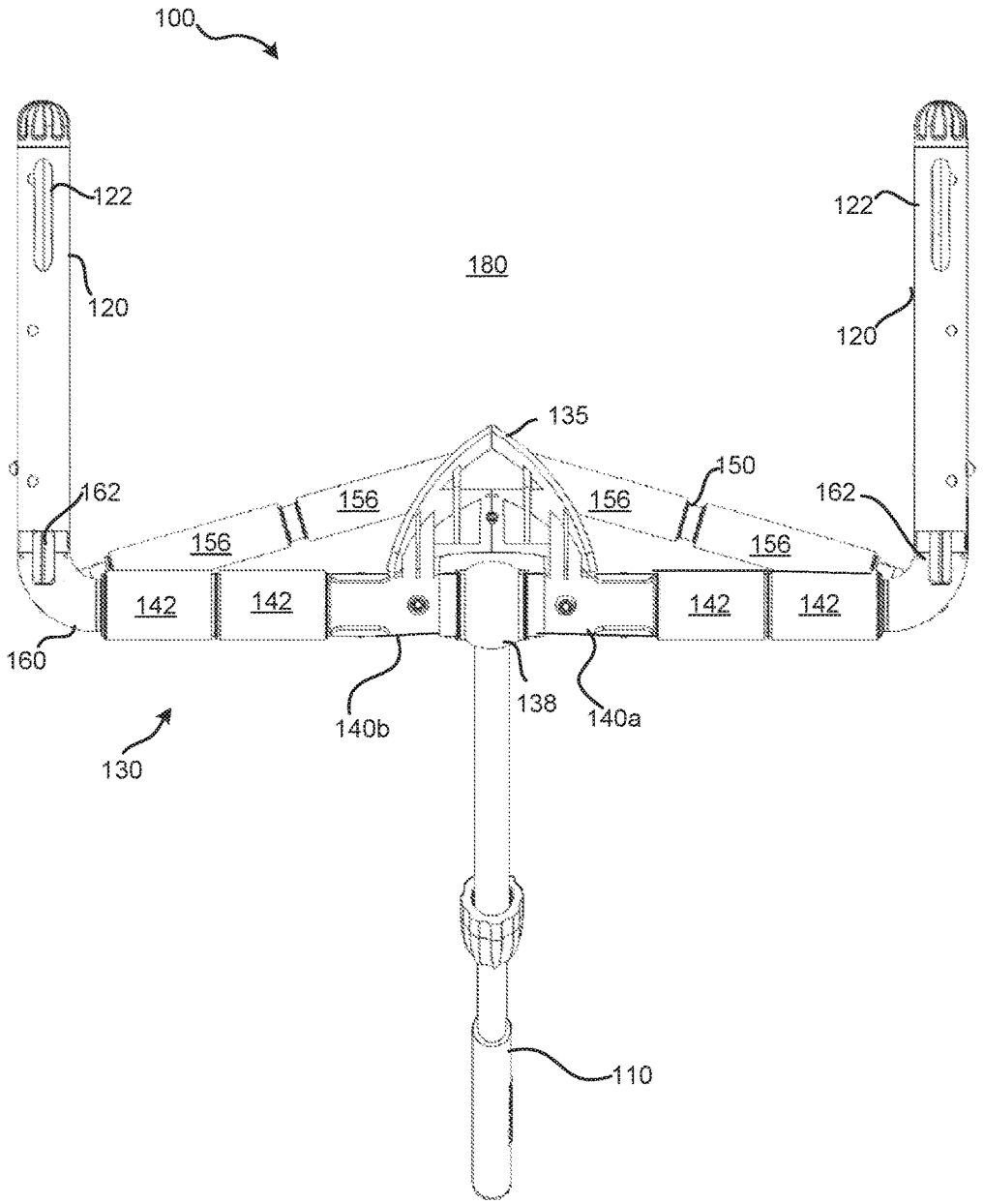
FIG. 5D is a bottom plan view of a ball collection device in accordance with one particular embodiment of the present invention.
Figure 5E:
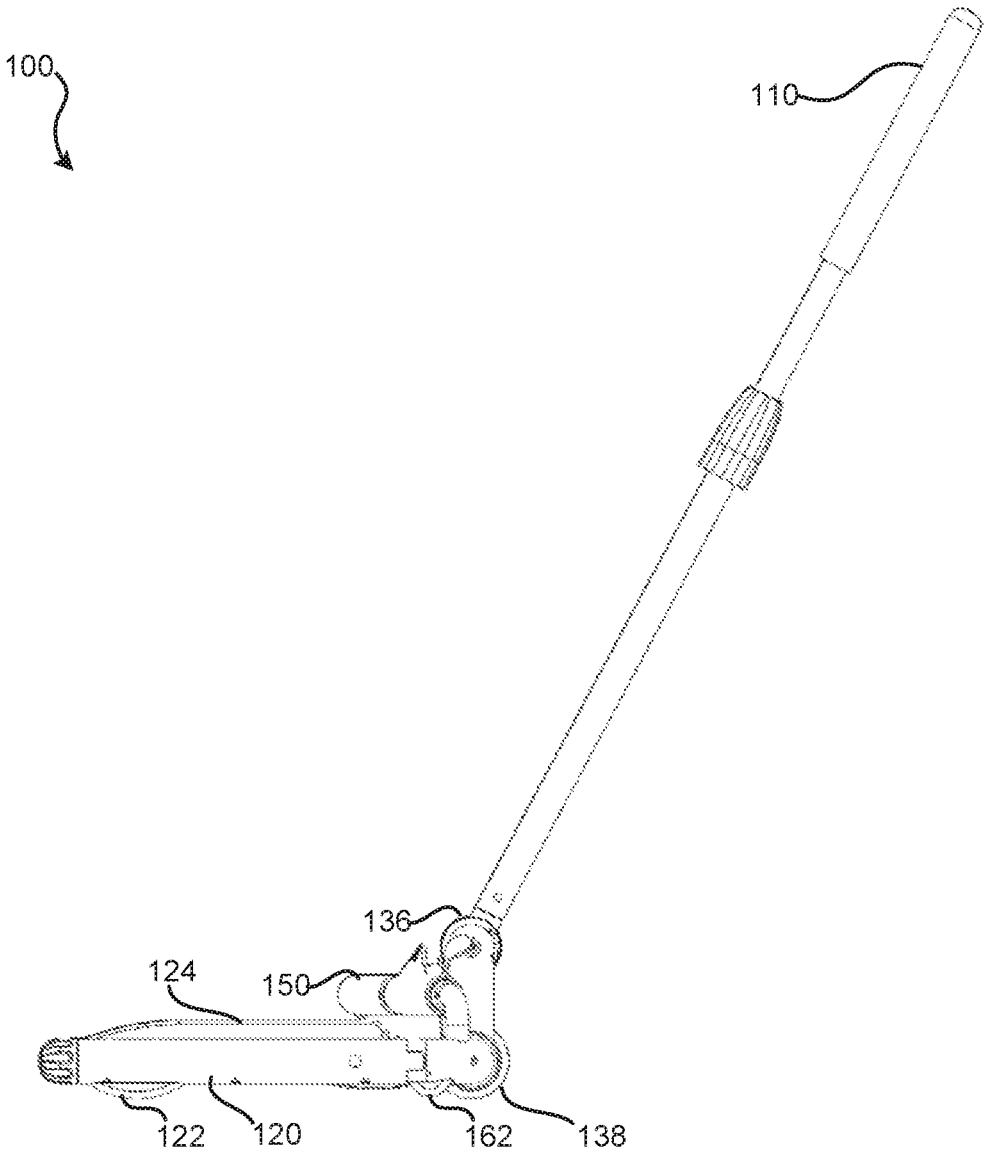
FIG. 5E is a side plan view taken from the left side of a ball collection device in accordance with one particular embodiment of the present invention.
Figure 5F:
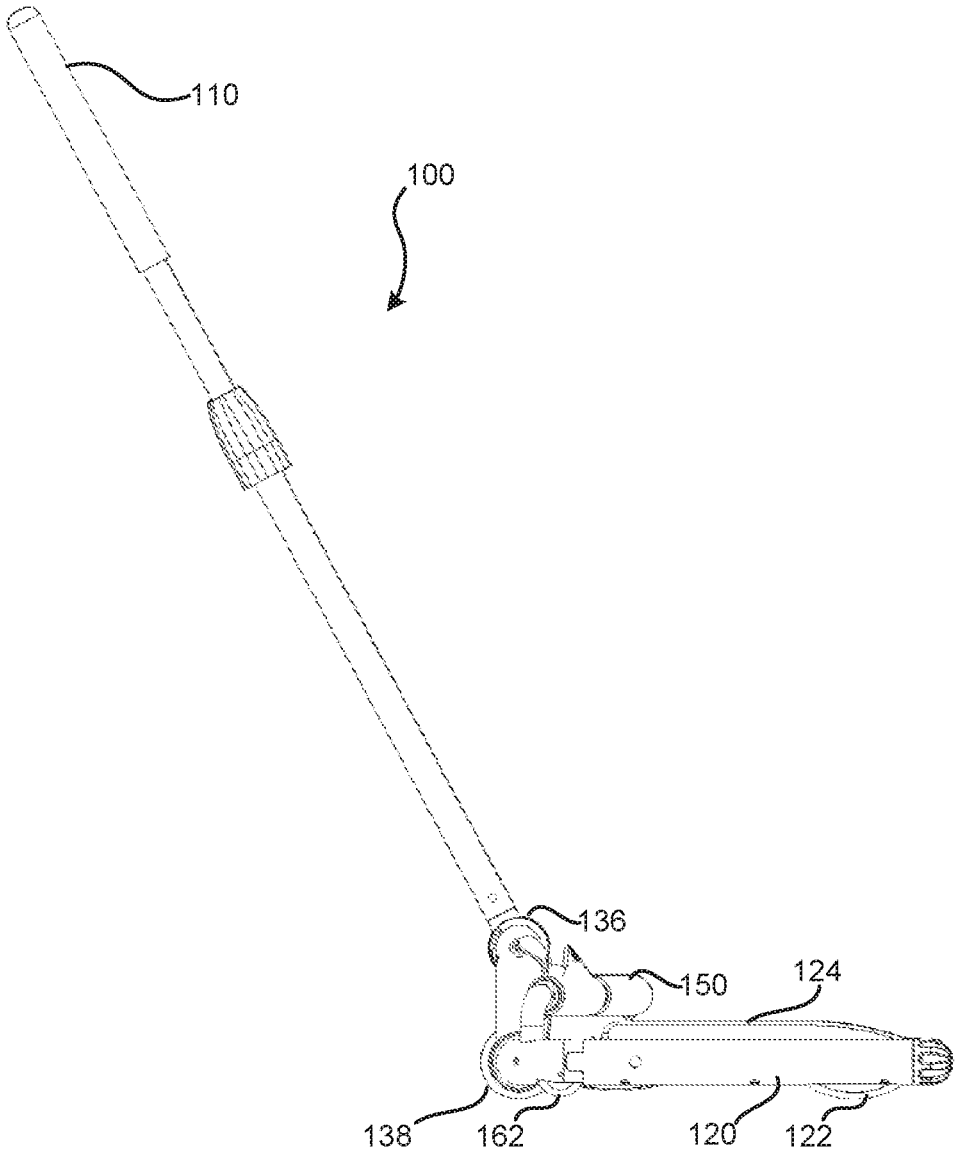
FIG. 5F is a side plan view taken from the right side of a ball collection device in accordance with one particular embodiment of the present invention.
Figure 6:
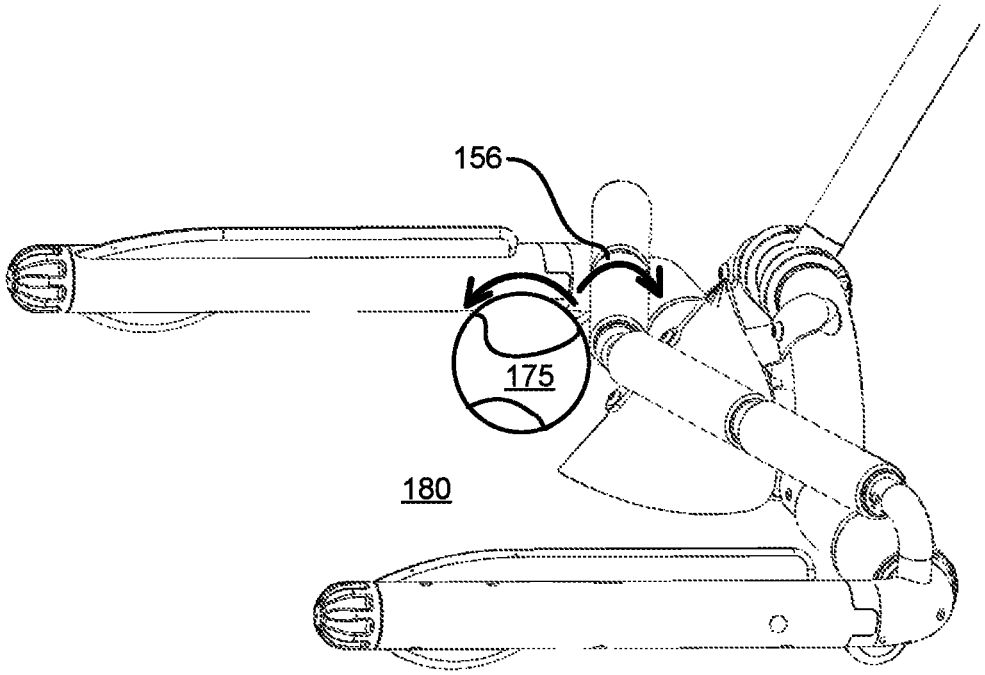
FIG. 6 is an enlarged view of a portion of the ball collector of one embodiment of the invention in contact with a ball located in the capture region.
Figure 7:
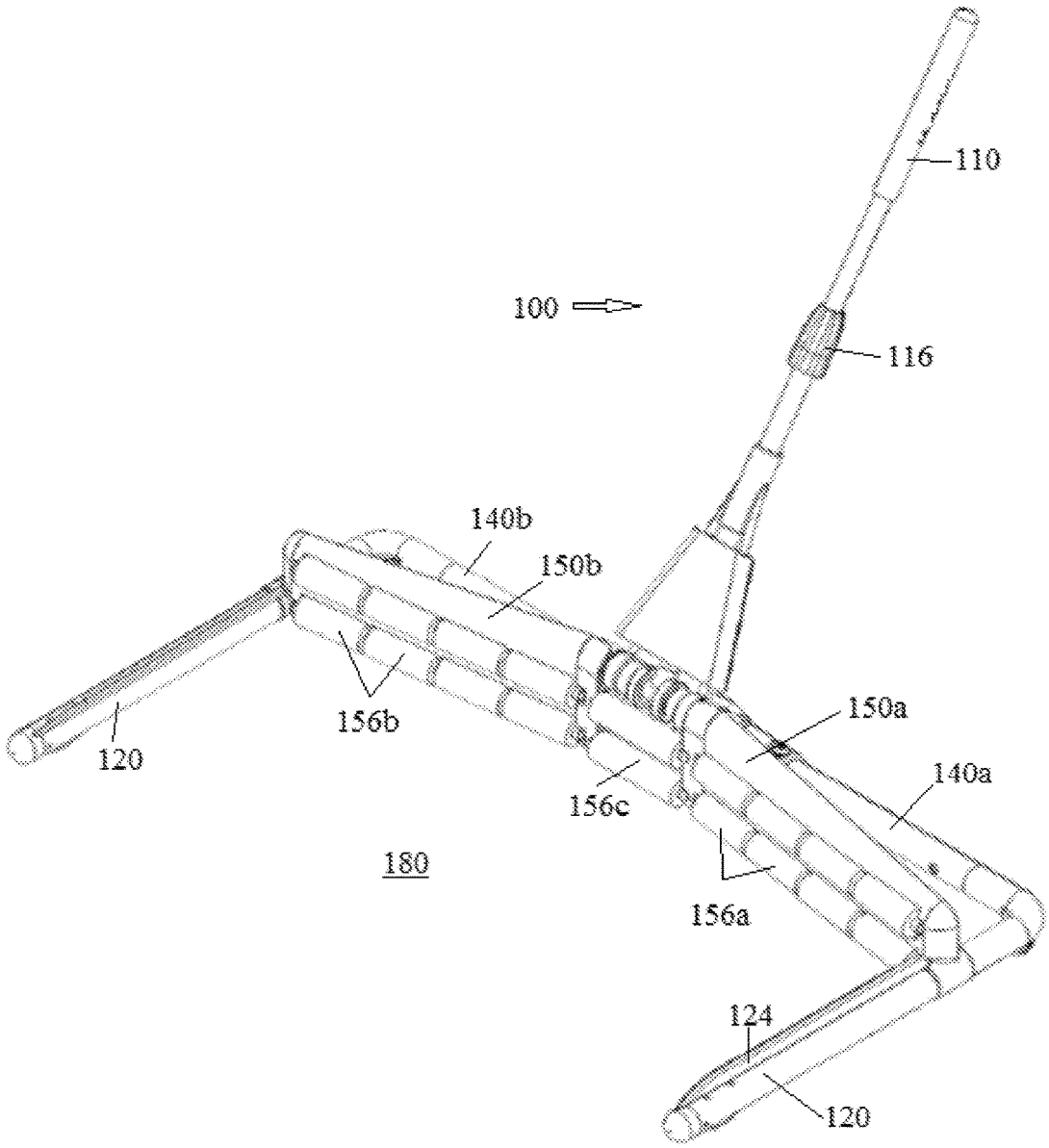
FIG. 7 is a front isometric view of another example of a ball collection device in accordance with the principles of the present invention.
Figure 8:
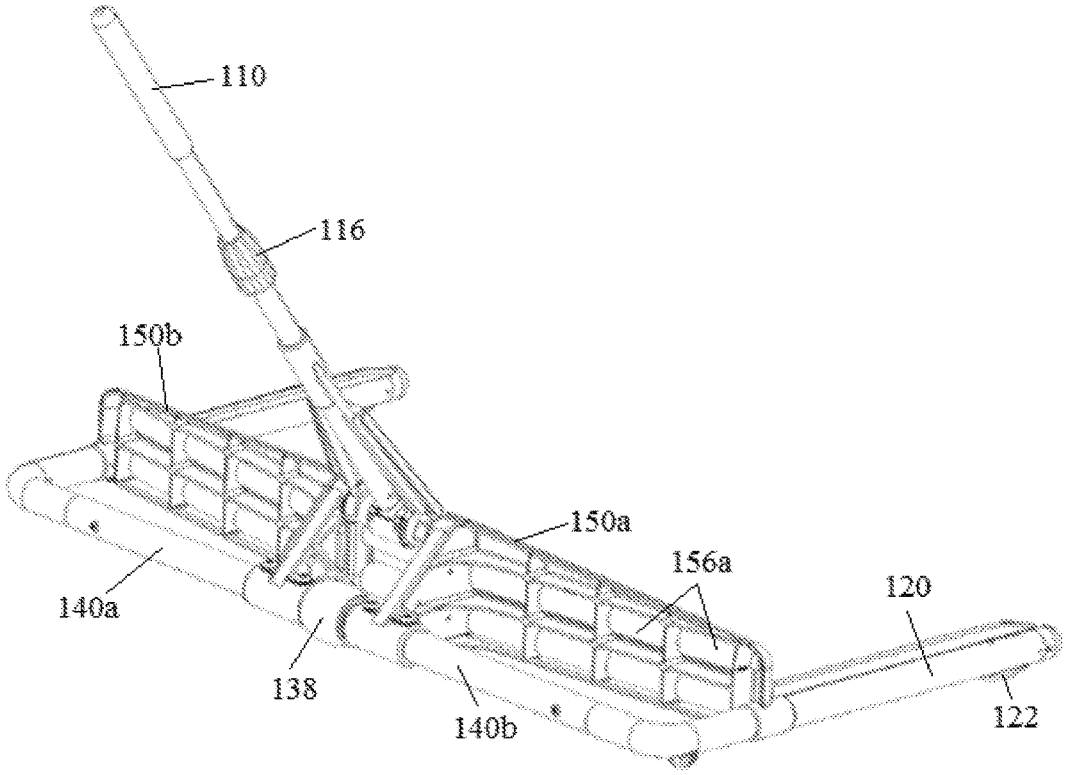
FIG. 8 is a rear isometric view of the ball collection device of FIG. 7.
Figure 9:
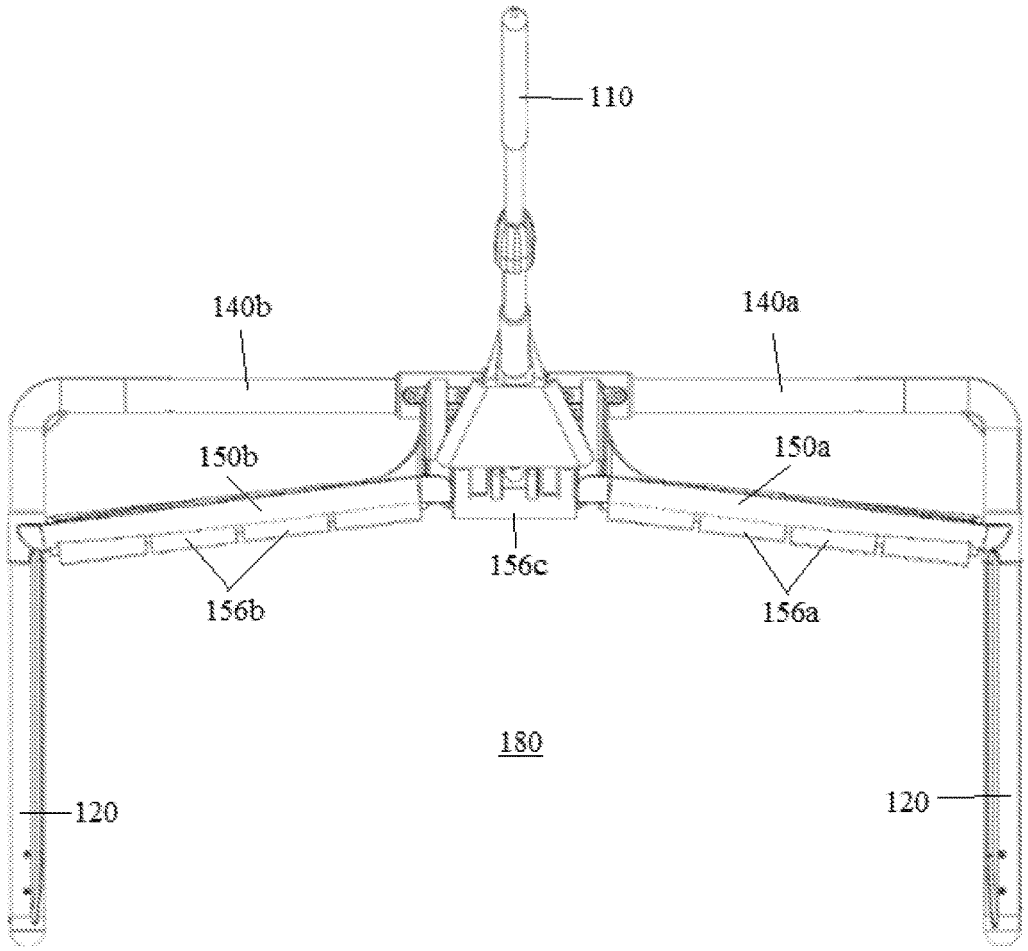
FIG. 9 is a top view of the ball collection device of FIG. 7.
Figure 10:
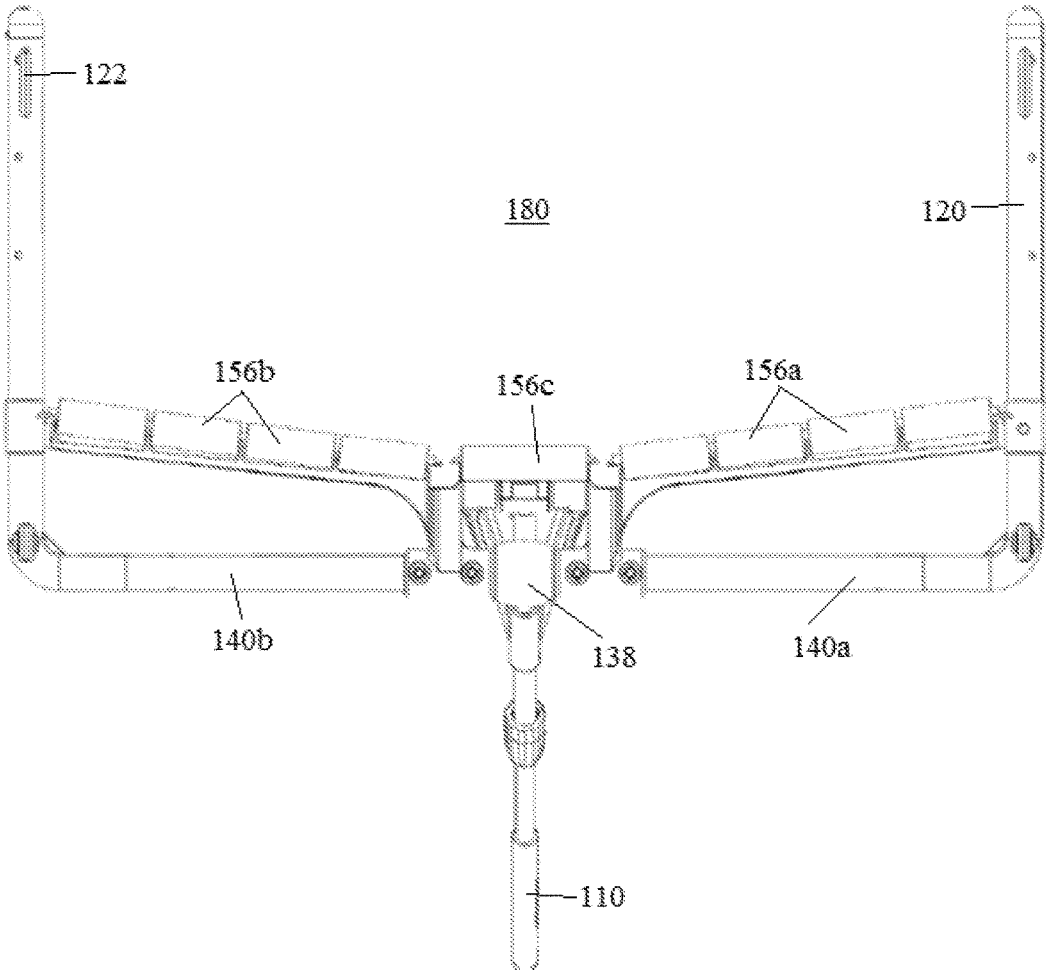
FIG. 10 is a bottom view of the ball collection device of FIG. 7.

The backplane 130 serves as the rear wall of an area or capture pen 180 in which balls 175 entering between the two arms 120 are entrapped. As such, in the present preferred embodiment, the backplane 130 is provided with several mechanisms for ensuring that the collector 100 will have great mobility while collecting balls 175 between the arms 120. Referring more particularly to FIG. 5B, the main point of ground contact for the ball collector 100 is a multi-directional center ball or roller ball 138 trapped in place between the two tube portions or segments 140*a* and 140*b* that form or constitute the bottom tube 140. In a less desirable embodiment, the roller ball 138 could be replaced by a roller mounted coaxially on a portion of the bottom tube 140. However, the use of a multi-directional center ball 138 provides a mobility that surpasses the use of a simple roller and is critical to the ability of the collector 100 to veer off quickly and easily at a tangent to the previous direction of travel of the collector 100. Consequently, the use of the roller ball 138 permits the collector 100 to easily and quickly change direction in order to collect balls 175 located at random spaced locations over a field, green or court.

For purposes of balance and ease of motion, the ball collector 100 of the present invention can additionally include further mobility elements aligned at its outer peripheral sides. For example, in the present embodiment shown, wheels 122 on the underside of the arms 120 and wheels 162 on the underside of the backplane 132, and more particularly, on the underside of the elbow portions 160 of the backplane 132, provide further mobility to the collector 100 and additionally serve to balance the peripheral sides of the collector 100 and arms 120 above and off of the ground, in use. It should be understood that the foregoing is not meant to limit the invention only to the use of wheels. Rather, for purposes of the present invention, the outer peripheral mobility elements can be wheels, skid pads, skis and/or rollers, as desired, without departing from the scope and spirit of the present invention. However, the outer peripheral mobility elements for each side of the ball collector 100 should be aligned with a longitudinal axis through the body of the arm 120 of that respective side.

The multi-directional center roller 138 entrapped between the bottom tube portions 140*a* and 140*b*, is protected in the front capture region or pen 180 (i.e., the region between the arms 120 and the backplane 130) by a ball shield 135. Ball shield 135 overlays the roller ball 138 in the front, to prevent balls 175 in the front capture region 180 from becoming entangled with the roller ball 138, or knocking the roller ball 138 out from between the bottom tube portions 140*a* and 140*b*. In the present particular embodiment illustrated, the ball shield 135 is V-shaped, with the point of the "V" aligned under a correspondingly V-shaped crossbar 150. The V-shaped example of the shield 135 directs and deflects balls and/or other external objects toward the sides or arms 120 of the capture region 180. Additionally, the ball shield 135 is held in place and stabilized by multiple points of contact with other frame portions of the backplane 130. For example, in the present preferred embodiment, the ball shield 135 includes braces 137 attached to the support bracket 132, braces 139 attached to each of the bottom tube portions 140*a* and 140*b*, and a central bracket 158 that secures the front of the ball shield 125 to the crossbar 150 and maintains its position relative thereto. Additionally, in one particular embodiment of the invention, the ball shield 135 includes flanges on its inner surface, to provide strength to the shield 135 and prevent deformation when impacted by a ball caught in the capture region 180.

Additionally, in the present preferred embodiment, the ball roller 138 is further protected by a V-shaped crossbar 150 that deflects captured balls 175 towards the sides of the capture region 180 (i.e., adjacent the arms 120), in use. More particularly, the V-shaped crossbar 150 is connected to the bottom tube 140 via the elbow portions 152 and 160. In one particular embodiment of the invention, the crossbar 150 includes a plurality of rollers 156 mounted coaxially around the tubular body of the crossbar 150. Each of the rollers 156 is mounted such that it can move rotationally about the body of the crossbar 150 when a tangential force is applied to the roller 156 by a ball trapped between the arms 120. Similarly, in one particularly preferred embodiment of the invention the backplane 130 additionally includes rollers 142 circumferentially mounted around the bottom tube 140, which are designed to rotate about the bottom tube 140, when contacted by a ball trapped between the arms 120. The rollers 142, 156 help ensure that the balls 175 move ahead of the backplane 130 as the collector 100 is rolled, and that they do not become trapped under the crossbar 150 or bottom tube 140. For example, as the ball collector 100 is pushed forward in use, balls 175 in the capture region 180 will eventually contact the backplane 130 at the crossbar 150 and/or the bottom tube 140. The rollers 142, 156 will roll about the respective tube 140/crossbar 150 and keep the captured balls 175 rolling forward (in a direction opposite to the rotational direction of the rollers 142, 156, as shown more particularly in FIG. 6), rather than allowing them to be pushed into the turf or trapped under the crossbar 150 or tube 140. In addition, the rollers 156 and/or the crossbar 150 may be vertically configured at a position with a sufficient height to allow the rollers 156 to prevent any balls from cascading or rolling over the top of the backplane 130 when the device 100 is used to gather large numbers (or sizes) of balls.

Providing the rollers 142, 156 of the backplane 130 also ensures that much less rotational friction exists for heavy balls, such as baseballs, that buttress up to the collector surfaces at the back portion of the capture region 180. Additionally, the reduction in rotational friction due to the rollers 142, 156 preserves operator mobility (i.e., the ability to continue pushing and operating the collector 100) when a high volume of heavy-type balls (such as baseballs) are in the capture region 180. Thus, the backplane rollers 142, 156 provide an efficient way to preserve the mobility of the ball collector 100. This feature of the ball collector 100 has industrial application, as it permits the ball collector 100 to be used to collect a broader range of balls, including heavier balls like baseballs, than other ball collectors presently available. The rollers 142, 156, in combination with the roller ball 138 of the backplane, provide a ball collector 100 that is much more user friendly than other ball collector devices currently known.

The backplane 130 additionally includes elbows 160, which curve around 90 degrees, or substantially 90 degrees, from the ends of the tube portions 140*a* and 140*b* distal from the roller ball 138. One end of each elbow is connected to the bottom tube 140, while the other end provides a connection for the arms 120. Additionally, the elbows 160 include a connection for receiving elbows 152, to which the crossbar 150 is connected. The elbows 152 raise the plane of the crossbar above the plane of the bottom tube 140. The raised crossbar 150 prevents balls 175 in the capture region 180 from being bounced or spun over the back of the collector 100 (i.e., over the bottom tube 140.

It should be noted that each of the components should be sized for the ball intended to be gathered in the capture region 180 of a particular ball collector 100. A ball collector 100 configured for collecting tennis balls or baseballs will have a lower crossbar 150 (i.e., a shorter elbow 152), as compared to a collector 100 configured to collect soccer balls or basketballs. In one particular embodiment of the invention, the crossbar 150 is omitted when the balls 175 to be collected are too small to need or contact the crossbar 150 (e.g., golf balls or table tennis balls). Each of the elbows 160, 152 of the present embodiment are configured to be removable from the backplane 130. For example, the elbow 152 may be attached to the elbow 160 using a spring pin hole arrangement, or even a friction fit, as desired. Similarly, each elbow 160 may be attached to the bottom tube 140 using a spring pin hole arrangement, or even a friction fit, as desired. The free end of each elbow 160 (i.e., the end not received in the tube 140) is configured to removably attach to one of the arms 120.

The Arms: Each of the arms 120 is configured to connect to, and be removable from, the backplane 130. In one particular embodiment of the invention, each arm 120 is attached to the backplane 130 at an elbow 160, via a fastener 120*a* which, in the present embodiment, is illustrated as a spring pin 160*a* on the elbow 160 that mates with a hole 120*a* through the shaft of each arm 120. The invention is not meant to be limited to this, however, as the arms 120 can be welded or otherwise permanently fixed to the backplane 130 without departing from the scope of the present invention.

Each of the arms 120 includes a mobility element, which, in the illustrated case, is a wheel or roller 122 aligned with the wheel or roller 162 of the elbow 160 along the longitudinal axis of the arm 120. As discussed hereinabove, this is not meant to be limiting, as other types of mobility elements can be used for the outer peripheral portions of the collector 100. In one particular embodiment, one or both of the wheels 122, 162 on each side of the collector 100 is/are replaced by a skid pad. In another particular embodiment of the invention both wheels 122, 162 on each side of the collector 100 are replaced by one or more skis. Other types of mobility elements can be used without departing from the scope or spirit of the present invention.

Additionally, in the present preferred embodiment, each of the arms 120 includes a wing 124 mounted to the upper surface portion thereof. The wings 124 are pigeon toed-in or angled in towards the capture region 180, to deflect and maintain balls 175 in the capture region 180. In one particular embodiment of the invention, the arms 120 are streamlined and designed to aesthetically resemble an aircraft nacelle.

Now referring to FIGS. 7-10, another example of the ball collection device 100 is shown having many of the features described above (e.g., many of the same components, detachment and disassembly constructs, etc.). In the illustrated example, the backplane 130 includes the crossbar 150 and components coupled thereto, which may include crossbar segments or portions 150*a* and 150*b* coupled to the handle 110 and the arms 120. Each crossbar segment or portion may include a tube, frame, or other mechanical construct configured to provide the functionality and features described herein. The crossbar segments 150*a*, 150*b* create or define the ball capture region 180 with the arms 120. The crossbar segments 150*a*, 150*b* may be horizontally offset from the tube portions 140*a*, 140*b* to create the ball capture region forward of the tube portions 140*a*, 140*b*.

The rollers 156 may be rotatable disposed or coupled to the crossbar 150 or portions thereof. For example, each of crossbar segment 150*a* and 105*b* may include a plurality of rollers 156*a*, 156*b* mounted thereon. The pluralities of roller 156*a*, 156*b* may each include two rows of rollers 156 vertically adjacent and parallel to each other. The vertical spacing and/or positioning of the higher or upper row of rollers 156*a*, 156*b* may be configured to provide sufficient height to allow the upper row of rollers to prevent any balls from cascading or rolling over the top of the backplane 130 when the device 100 is used to gather large numbers (or sizes) of balls. Moreover, although the rollers are illustrated as substantially aligned with one another (see, e.g., the top view of FIG. 9), the rows of rollers may also be angled or horizontally offset from each other as well to provide an angled collection plane that can knock down any balls that bounce up or accumulate in front of the rollers when using the device. To that effect, the upper rows of rollers may be positioned at least partially forward of the lower rows of rollers, creating somewhat of a roller overhang on the crossbar 150.

The ball collection device 100 may also include one or more rollers 156*c* between the crossbar segment 150*a* and 105*b* and/or otherwise substantially in the middle of the crossbar 150 in proximity to the multi-directional roller ball 138. The rollers 156*c* may be included on the device 100 as an alternative to the shield 135. The rollers 156*c* shield and direct balls or other external objects away from the roller ball 138 and back toward the capture region 180.

In use, the ball collector 100 is maneuvered through a court or field in order to collect balls 175 strewn therethrough. The multi-directional roller ball 138 permits the ball collector to be easily turned or maneuvered in any direction, 360 degrees relative to any point. Balls 175 are captured by capturing them between the arms 120. As the ball collector 100 is pushed forward, balls 175 in the capture region 180 between the two arms 120 contact the backplane 130 and, in particular, the bottom tube 140 and/or crossbar 150. Rollers 142, 156 on the bottom tube 140 and crossbar 150 contact the balls 175 and roll about the bottom tube 140 and crossbar 150, respectively, in order to propel the balls 175 forward with the ball collector. Balls 175 contacting the V-shaped crossbar 150, as the collector 100 is advanced, are deflected to the sides of the capture region 180 by the crossbar 150, towards the arms 120. Wings 124 on the arms 120 corral the balls 175 within the capture area.

The present invention provides a ball collection device as described herein. Alternate to the embodiment shown in the drawings, if desired, the collector 110 can be constructed using fewer pieces without departing from the scope or spirit of the present invention. For example, in one particular embodiment of the invention, each arm 120 can be formed with a portion of the bottom tube 140, wherein a bend is made in the tube in place of the elbow 160. Thus, in this embodiment, two unitary tube/arm portions are provided, one on either side of the ball roller 138.

As described herein, the ball collection device 100 can also be readily disassembled into the core components—the handle, the arms, and the backplane—to allow the device 100 to be stored and transported with a significantly reduced footprint, such as in a duffle bag or the like.

It will be appreciated by persons skilled in the art that the present invention is not limited to what has been particularly shown and described herein above. In addition, unless mention was made above to the contrary, it should be noted that all of the accompanying drawings are not to scale. Of note, the system components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein. Moreover, while certain embodiments or figures described herein may illustrate features not expressly indicated on other figures or embodiments, it is understood that the features and components of the examples disclosed herein are not necessarily exclusive of each other and may be included in a variety of different combinations or configurations without departing from the scope and spirit of the invention. A variety of modifications and variations are possible in light of the above teachings without departing from the scope and spirit of the invention, which is limited only by the following claims.

What is claimed is:

1. A ball collection device, comprising:
- a handle;
- a multi-directional roller ball coupled to an end of the handle;
- a bottom tube coupled to the roller ball substantially perpendicular to the handle;
- a first arm coupled to and extending substantially perpendicular from the bottom tube; and
- a second arm coupled to and extending substantially perpendicular from the bottom tube.

2. The ball collection device of claim 1, wherein the bottom tube includes a first tube segment and a second tube segment, wherein the first and second tube segments enclose at least a portion of the roller ball.

3. The ball collection device of claim 1, further comprising a ball shield covering at least a portion of the roller ball, wherein the ball shield is configured to deflect external objects away from the roller ball.

4. The ball collection device of claim 1, wherein at least one of the first and second arms includes a wing extending at an angle therefrom.

5. The ball collection device of claim 1, further comprising a crossbar coupled to the handle adjacent to the bottom tube.

6. The ball collection device of claim 5, wherein the crossbar is substantially parallel to the bottom tube.

7. The ball collection device of claim 5, wherein the crossbar is substantially V-shaped.

8. The ball collection device of claim 5, further comprising at least one roller coaxially and rotatably mounted on the crossbar.

9. The ball collection device of claim 5, further comprising a curvilinear support bracket connecting the handle to at least one of the crossbar and bottom tube.

10. The ball collection device of claim 1, further comprising at least one roller coaxially and rotatably mounted on the bottom tube.

11. The ball collection device of claim 1, further comprising a first wheel coupled to the first arm and a second wheel coupled to the second arm.

12. The ball collection device of claim 1, wherein a length of the handle is selectively adjustable.

13. A ball collection device, comprising:
- a handle;
- at least one crossbar coupled substantially perpendicular to the handle;
- a multi-directional roller ball coupled to the at least one crossbar; and
- a plurality of arms, wherein the at least one crossbar and the plurality of arms form a ball capture region.

14. The ball collection device of claim 13, wherein the at least one crossbar includes a bottom tube and a crossbar substantially parallel and vertically adjacent to the bottom tube.

15. The ball collection device of claim 14, wherein the bottom tube includes a first tube segment and a second tube segment, wherein the first and second tube segments enclose at least a portion of the roller ball.

16. The ball collection device of claim 13, wherein each of the plurality of arms includes a wing extending at an angle therefrom configured to direct balls towards the ball capture region.

17. The ball collection device of claim 13, further comprising a plurality of rollers rotatably coupled to the at least one crossbar.

18. The ball collection device of claim 17, wherein each of the plurality of rollers is concentrically mounted on the at least one crossbar.

19. A ball collection device, comprising:
- a handle;
- a first tube segment and a second tube segment coupled substantially perpendicularly to the handle;
- a multi-directional roller ball coupled to the first and second tube segments;
- a crossbar coupled to the handle horizontally offset from the first and second tube segments;
- a first arm coupled to and extending substantially perpendicular from the first tube segment;
- a first wing extending from the first arm that is configured to deflect objects downward;
- a second arm coupled to and extending substantially perpendicular from the second tube segment;
- a second wing extending from the second arm that is configured to deflect objects downward; and
- a plurality of rollers rotatably coupled to the crossbar.

20. The ball collection device of claim 19, wherein the plurality of rollers includes a first plurality of rollers substantially aligned with each other and vertically adjacent to a second plurality of rollers substantially aligned with each other.

* * * * *